United States Patent [19]

Judge

[11] Patent Number: 4,842,503

[45] Date of Patent: Jun. 27, 1989

[54] SPINNING PACK DESIGN

[75] Inventor: Ronald J. Judge, Kingston, Canada

[73] Assignee: E. I. Du Pont de Nemours and Company, Wilmington, Del.

[21] Appl. No.: 261,563

[22] Filed: Oct. 24, 1988

[51] Int. Cl.[4] ..... D01D 1/06

[52] U.S. Cl. ..... 425/72.2; 264/103; 264/176.1; 264/211.22; 264/211.23; 425/145; 425/382.2

[58] Field of Search ..... 425/72.2, 462, 463, 425/131.5, 145, 146, 382.2; 264/176.1, 171, 40.7, 40.3, 211.22, 211.23

[56] References Cited

U.S. PATENT DOCUMENTS

| | | | |
|---|---|---|---|
| 2,922,188 | 1/1960 | Bossen | 425/145 |
| 2,969,561 | 1/1961 | McCormick et al. | 264/205 |
| 3,408,277 | 10/1968 | Martin et al. | 264/168 |
| 3,437,725 | 4/1969 | Pierce | 264/211.22 |
| 3,488,806 | 1/1970 | DeCecco et al. | 425/463 |
| 3,752,616 | 8/1973 | Matsui et al. | 425/131 |
| 3,819,777 | 6/1974 | Vermeerbergen | 264/211.23 |
| 3,881,850 | 5/1975 | Stockbridge | 425/72 |
| 3,963,406 | 6/1976 | Reker | 425/463 |
| 4,370,114 | 6/1983 | Okamoto et al. | 425/131.5 |
| 4,708,619 | 11/1987 | Balk | 425/141 |

*Primary Examiner*—Jay H. Woo
*Assistant Examiner*—Khank Nguyen

[57] ABSTRACT

An apparatus for spinning includes a polymer inlet zone and a spinneret assembly. A first metering pump for pumping a first set of molten polymer streams of equal flow rate to the polymer inlet zone and a second metering pump for pumping a second set of two molten polymer streams of equal flow rate to the polymer inlet zone are provided. The second pump having twice the capacity of the first pump. The spinneret assembly comprises a pair of spinnerets interchangeably locatable in the spinning pack. One of the spinnerets is adapted to combine the first set of streams to produce three ends of filaments and the other of the spinnerets is adapted to combine each of the first streams with a respective one of the second streams to provide two ends of filaments.

6 Claims, 4 Drawing Sheets

SPINNING PACK DESIGN

This invention relates to a spinning pack design and more particularly to a spinning pack for producing two or three ends of polymer filaments.

A spinning pack for producing polymeric thread generally comprises a pump for pumping molten polymer and a polymer distribution block for directing the streams exiting from the pump towards a plurality of sand filters. Beneath the sand filters is a spinneret having many capillaries extending therethrough. The polymer passes through the spinneret in the form of filaments.

Commercially available pumps can provide either one, two or four streams of polymer There are no commercially available pumps that provide three streams of polymer A two stream or four-stream pump is conventionally used to produce two or four ends of filaments respectively. Each end contains 140 filaments. The problem with using such pumps is that certain downstream apparatus designs will accomodate a maximum of only three ends of filaments. It would be desirable with such designs to be able to produce either two or three ends of filaments having different decitex (weight in grams per 10,000 m). It has been attempted to do this by using distribution plates before the spinnerets to distribute flow so that either two or three ends of filaments may be produced. The disadvantage with this approach is that such distribution plates are designed only for a certain flow rate and so will not provide the desired flow distribution if the process speed is changed.

It is an object of the present invention to obviate or mitigate the above-mentioned disadvantages.

Accordingly, the invention provides an apparatus for spinning, said apparatus comprising:

a spinning pack comprising a polymer inlet zone and a spinneret assembly;

a first metering pump for pumping a first set of molten polymer streams of equal flow rate to said polymer inlet zone; and a second metering pump for pumping a second set of two molten polymer streams of equal flow rate to said polymer inlet zone, said second pump having twice the capacity of said first pump; wherein said spinneret assembly comprises a pair of spinnerets interchangeably locatable in said spinning assembly, one of said spinnerets being adapted to combine said first set of streams to produce three ends of filaments and the other of said spinnerets being adapted to combine each of said first streams with a respective one of said second streams to provide two ends of filaments.

The present invention is capable of producing either two or three ends of filaments at substantially any process speed. This allows for the production of filaments of more than one decitex using the same pump arrangement. Moreover, since a maximum of three ends are producible, the present invention may be advantageously used with downstream apparatus that is only capable of accomodating a maximum of three ends.

A three end spinneret is used if it is desired to obtain three ends of filaments. This spinneret is replaceable with a two end spinneret if it is desired to obtain two ends of filaments. The three end spinneret has three spaced, parallel sets of preferably 140 capillaries and the two end spinneret has two spaced, parallel sets of preferably 140 capillaries.

The polymer inlet zone preferably comprises a polymer distribution block having a pair of first inlets for respective ones of the first set of polymer streams and a pair of second inlets for respective ones of the second set of polymer streams, the first inlets being located between the second inlets. When a three end spinneret is used, the outer two streams pass through respective outer sets of capillaries and the two inner streams both pass through the inner set of capillaries. When a two end spinneret is use, each pair of adjacent inner and outer streams both pass through a respective set of capillaries.

The pumps are preferably of sufficient capacity to produce two ends of 144 filaments of 1400 dtex or three ends of 144 filaments of 940 dtex.

The invention will be further described, by way of illustration only, with reference to the following drawings in which.

Figure 1:
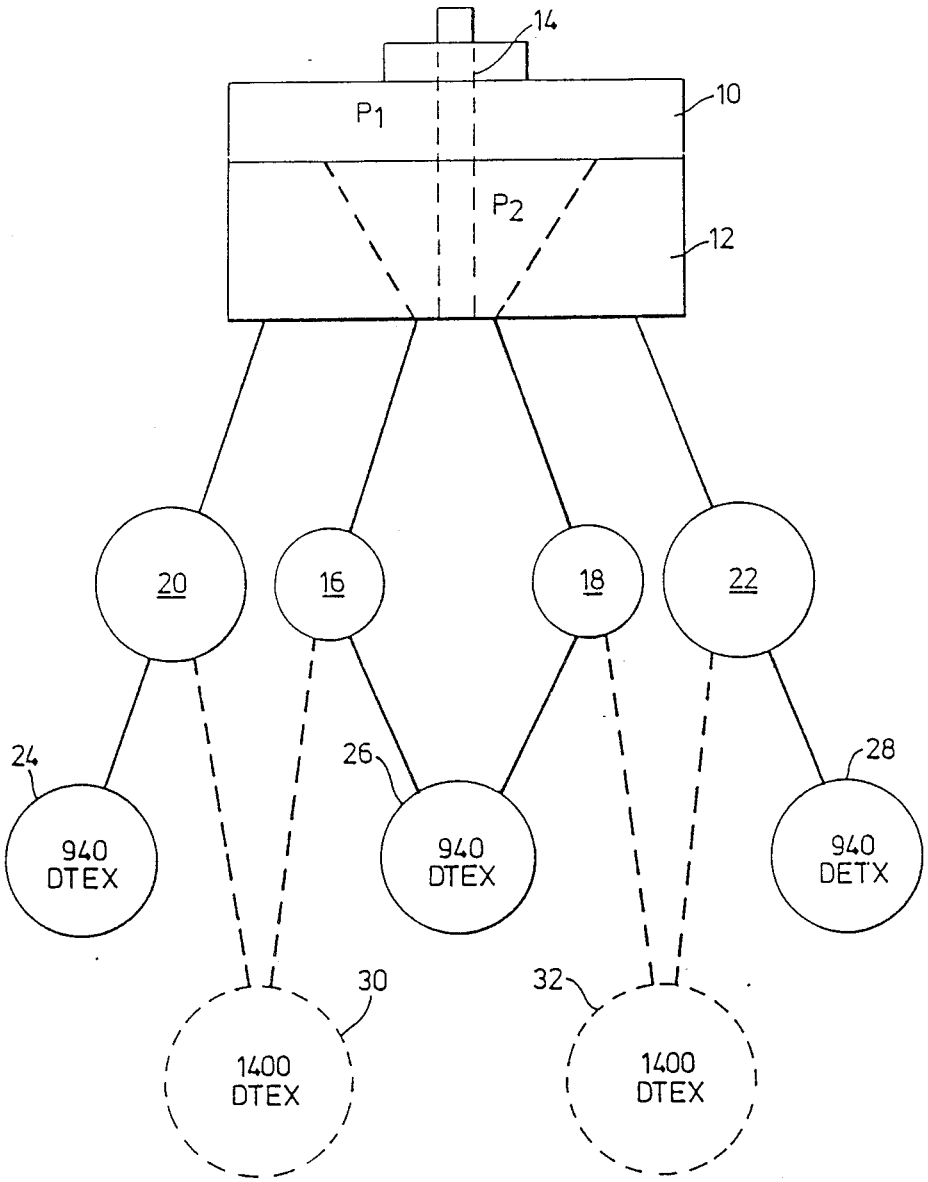
FIG. 1 is a diagrammatic representation of a system for producing either two or three ends of polymer.
Figure 2A:
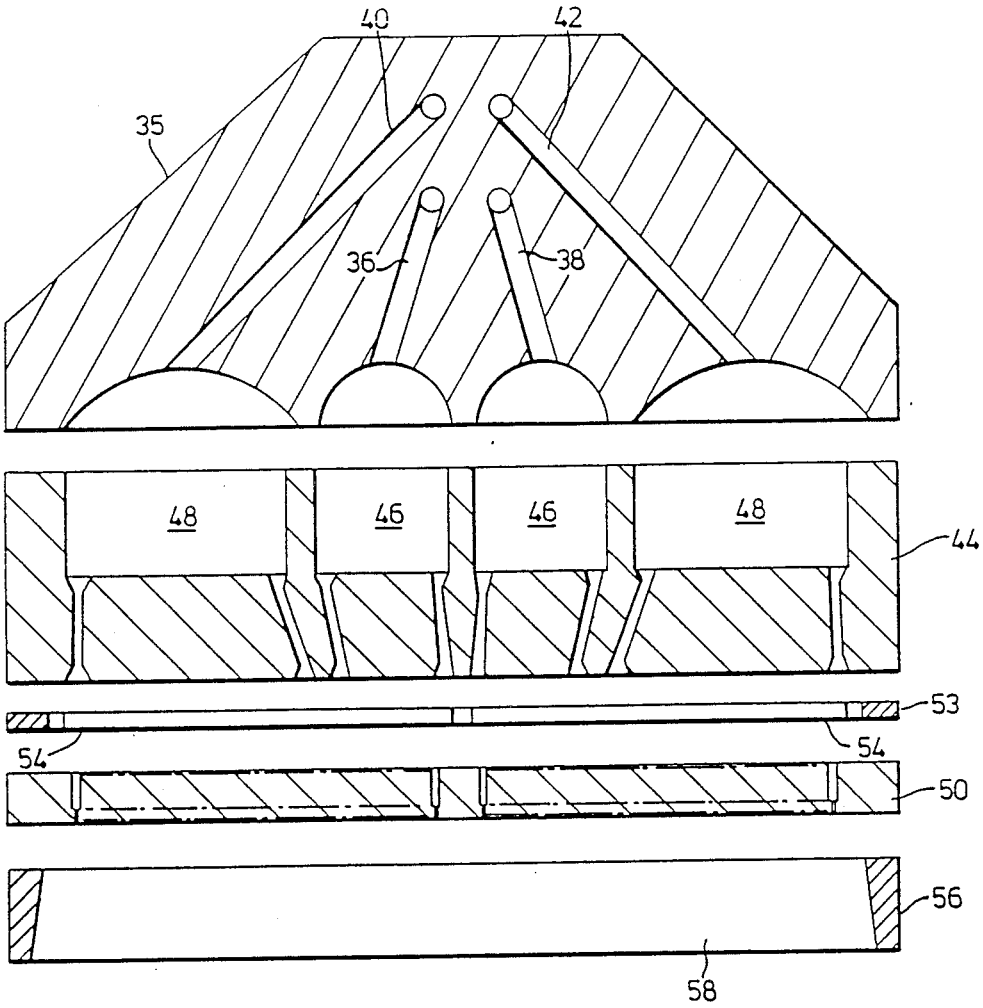
FIG. 2A is a cross-sectional view of a spinning pack having a spinneret suitable for producing two ends of filaments.

The general concept of the present invention is depicted in FIG. 1. A pair of pumps 10, 12 are connected to the same drive shaft 14. The volumetric capacity of the first pump 10 is half that of the second pump 12. Each pump is capable of producing two equal streams of polymer. The outlets of the first and second pumps are arranged so that the two streams 16, 18 exiting from the first pump respectively are located between two streams 20, 22 exiting from the second pump. To obtain three ends 24, 26, 28 of 940 dtex filaments, the two middle streams 16 and 18 are combined and to obtain two ends 30, 32 of 1400 dtex filaments, adjacent pairs of streams, ie.—streams 16 and 20 and streams 18 and 22, are combined. A spinning pack 34 for producing two ends of filaments is depicted in FIG. 2A. This spinning pack comprises a pair of pumps of the configuration of FIG. 1 (not shown) connected to a distribution block 35. This block has inlets 36, 38 for the introduction of a pair of streams from a first pump and inlets 40, 42 for the introduction of a pair of streams from a second pump. The streams from the first pump each have half the flow rate of the streams from the second pump.

Located beneath the distribution block 35 is a sand filter 44 comprising four filter chambers 46, 48. The two inner chambers 46 are smaller than the two outer chambers 48. The inlets 40, 42 are connected to respective ones of the outer chambers 48 and the inlets 36, 38 are connected to respective ones of the inner chambers 48.

Figure 3A:
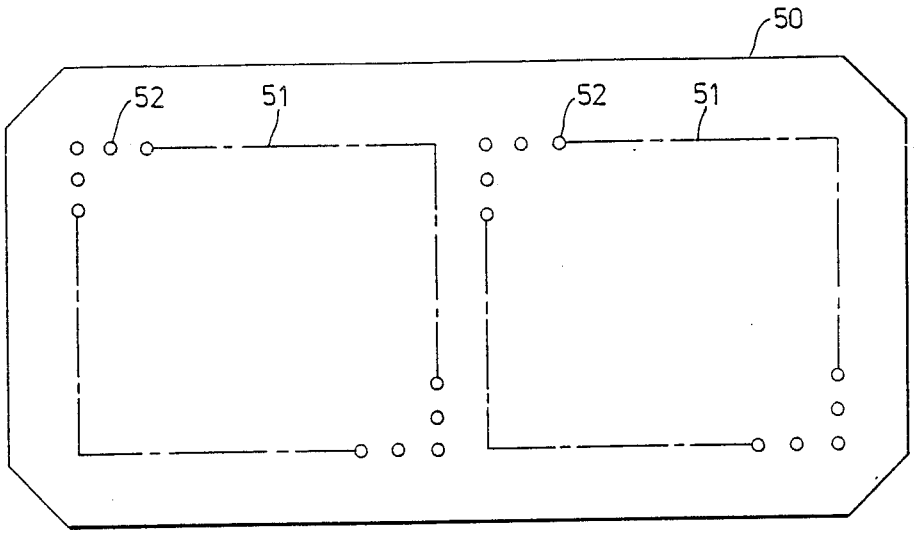
FIG. 3A is a view from above of a spinneret used in the spinning pack of FIG. 2A.

A spinneret 50 is located below the sand filter 44. Details of the spinneret 50 may best be seen in FIG. 3*a*. Two sets 51 of 140 capillaries 52 extend transversely through the spinneret 50.

Between the sand filter 44 and the spinneret 50 is a gasket 53. This gasket 53 has two openings 54 therein corresponding in size to respective ones of the two sets 51 of capillaries. The gasket 53 serves to seal the spinneret and to seal the two sets of capillaries from one another.

A retainer 56 is located below the spinneret 50. This retainer has an opening 58 therein to accomodate the ends of filaments exiting from the spinneret.

Figure 2B:
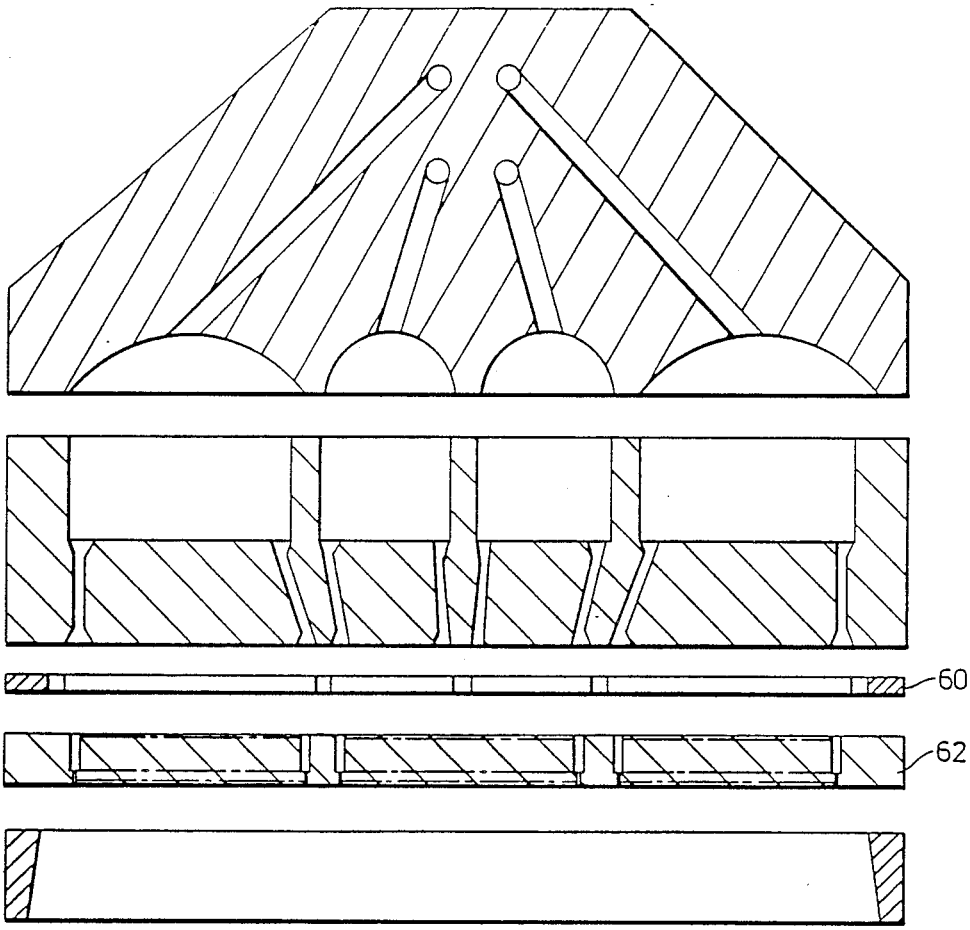
FIG. 2B is a cross-sectional view of a spinning pack having a spinneret suitable for producing three ends of filaments.

The spinning pack of FIG. 2B is identical to that of FIG. 2A except that the gasket 53 and spinneret 50 for producing two ends of filaments have been removed and replaced with a gasket 60 and spinneret 62 for producing three ends of filaments.

Figure 3B:
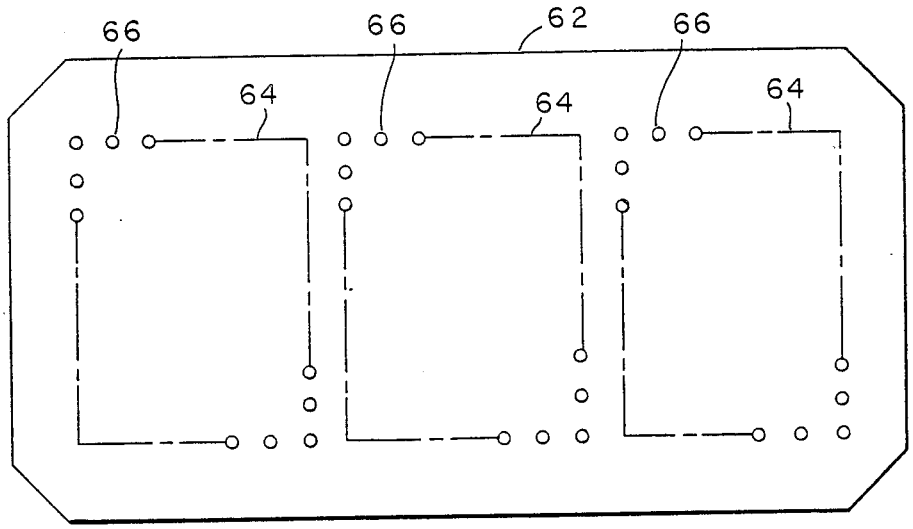
FIG. 3B*a* is a view from above of a spinneret used in the spinning pack of FIG. 2B.

As may be seen in FIG. 3B, three sets 64 of 140 capillaries 66 extend transversely through the spinneret 62. Referring back to FIG. 2B, the gasket 60 has three openings 66 therein corresponding in size to respective ones of the three sets 64 of capillaries.

I claim:

1. Apparatus for spinning, said apparatus comprising:

a spinning pack comprising a polymer inlet zone and a spinneret assembly;

a first metering pump for pumping a first set of molten polymer streams of equal flow rate to said polymer inlet zone; and a second metering pump for pumping a second set of two molten polymer streams of equal flow rate to said polymer inlet zone, said second pump having twice the capacity of said first pump;

wherein said spinneret assembly comprises a pair of spinnerets interchangeably locatable in said spinning pack, one of said spinnerets being adapted to combine said first set of streams to produce three ends of filaments and the other of said spinnerets being adapted to combine each of said first streams with a respective one of said second streams to provide two ends of filaments.

2. The apparatus of claim 1 wherein said polymer inlet zone comprises a pair of first inlets for respective ones of said first set of polymer streams and a pair of second inlets for respective ones of said second set of polymer streams, said first inlets being located between said second inlets.

3. The apparatus of claim 2 wherein said one of said spinnerets comprises three equally sized sets of capillaries, said sets being spaced from one another.

4. The apparatus of claim 3 wherein said other of said spinnerets comprises two equally sized sets of capillaries, said sets being spaced from one another.

5. The apparatus of claim 1 wherein the first and second pumps are of sufficient capacity to produce two ends of 1400 dtex or three ends of 940 dtex.

6. The apparatus of claim 1 wherein the first and second pumps are driven by the same drive unit.

* * * * *